US007834300B2

(12) United States Patent
Zemany et al.

(10) Patent No.: US 7,834,300 B2
(45) Date of Patent: Nov. 16, 2010

(54) BALLISTIC GUIDANCE CONTROL FOR MUNITIONS

(75) Inventors: Paul D. Zemany, Amherst, NH (US); Mark A. Carlson, Amherst, NH (US); John A. Maynard, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/629,060

(22) PCT Filed: Feb. 7, 2006

(86) PCT No.: PCT/US2006/004531

§ 371 (c)(1), (2), (4) Date: Dec. 8, 2006

(87) PCT Pub. No.: WO2006/086528

PCT Pub. Date: Aug. 17, 2006

(65) Prior Publication Data

US 2007/0241227 A1 Oct. 18, 2007

(51) Int. Cl.

| | |
|---|---|
| ***F42B 15/01*** | (2006.01) |
| ***F42B 10/60*** | (2006.01) |
| ***F42B 10/62*** | (2006.01) |
| *F42B 15/00* | (2006.01) |
| *F42B 10/00* | (2006.01) |

(52) U.S. Cl. ..... 244/3.15; 244/3.1; 244/3.16; 244/3.19; 244/3.21; 102/382; 102/384; 102/473; 102/501; 701/200; 701/224

(58) Field of Classification Search ..... 244/3.1–3.3; 342/61–65, 165–175, 195; 701/3, 200, 224; 89/41.01–41.22; 102/382, 384, 473, 501
See application file for complete search history.

(56) References Cited

U.S. PATENT DOCUMENTS

| | | | | | |
|---|---|---|---|---|---|
| 2,403,387 | A | * | 7/1946 | McLennan | 244/3.16 |
| 2,448,007 | A | * | 8/1948 | Ayres | 244/3.11 |
| 2,969,018 | A | * | 1/1961 | Bowden et al. | 244/3.16 |
| 2,997,594 | A | * | 8/1961 | MacNeille | 244/3.16 |
| 2,997,595 | A | * | 8/1961 | Cary et al. | 244/3.16 |
| 3,000,307 | A | * | 9/1961 | Trotter, Jr. | 244/3.16 |
| 3,001,186 | A | * | 9/1961 | Baltzer | 244/3.15 |
| 3,065,931 | A | * | 11/1962 | Dixon et al. | 244/3.16 |
| 3,206,144 | A | * | 9/1965 | Welti | 244/3.16 |
| 3,448,271 | A | * | 6/1969 | Aldrich et al. | 244/3.16 |
| 3,523,659 | A | * | 8/1970 | Eppherson, Jr. | 244/3.17 |
| 3,737,122 | A | | 6/1973 | Solov et al. | |

(Continued)

*Primary Examiner*—Bernarr E Gregory
(74) *Attorney, Agent, or Firm*—Sand & Sebolt; Michael Sand; Daniel J. Long

(57) ABSTRACT

A method and system for guiding and controlling an ordinance body having a trajectory and a bore sight angle including making corrections to the trajectory based on bore sight angle vs. time history. The system is incorporated with existing fuse components in a replacement kit for existing munitions. The method determines nominal time values of the ballistic trajectory of the munition in relation to launch time and determines deviation from the nominal time values by an algorithm by analyzing signals received from a source of radiation located at the target. A processor determines lateral (left/right) and range errors and provides commands to a plurality of flight control surfaces mounted on the munition.

17 Claims, 6 Drawing Sheets

U.S. PATENT DOCUMENTS 3,843,076 A * 10/1974 King et al. ..... 244/3.16
3,990,657 A 11/1976 Schott
4,111,382 A 9/1978 Kissinger
4,136,343 A 1/1979 Heffner et al.
4,264,907 A * 4/1981 Durand et al. ..... 342/62
4,288,049 A 9/1981 Alpers
4,347,996 A * 9/1982 Grosso ..... 244/3.16
4,383,663 A 5/1983 Nichols
4,522,356 A 6/1985 Lair et al.
4,606,514 A 8/1986 Sundermeyer
4,662,580 A 5/1987 Nelson
4,711,412 A 12/1987 Wallermann
4,856,733 A 8/1989 Lachmann
4,883,239 A 11/1989 Lachmann et al.
5,260,709 A 11/1993 Nowakowski
5,467,940 A 11/1995 Steuer
5,478,028 A 12/1995 Snyder
5,631,654 A 5/1997 Karr
5,647,558 A * 7/1997 Linick ..... 244/3.11
5,660,355 A 8/1997 Waymeyer
5,762,291 A 6/1998 Hollis et al.
5,788,178 A * 8/1998 Barrett, Jr. ..... 244/3.11
5,816,531 A 10/1998 Hollis et al.
5,826,821 A 10/1998 Brandon et al.
6,069,584 A 5/2000 Johnson
6,244,536 B1 6/2001 Cloutier
6,345,785 B1 2/2002 Harkins et al.
6,467,721 B1 10/2002 Kautzsch et al.
6,621,059 B1 9/2003 Harris et al.
6,722,609 B2 * 4/2004 Linick ..... 244/3.21
7,079,070 B2 * 7/2006 Kongelbeck et al. ..... 342/62

* cited by examiner

BALLISTIC GUIDANCE CONTROL FOR MUNITIONS

CROSS REFERENCE TO RELATED APPLICATION

This application claims rights under 35 USC 119(e) from U.S. application Ser. No. 60/650,710, filed Feb. 7, 2005; the contents of which are incorporated herein by reference.

BACKGROUND OF THE INVENTION

1. Field of the Invention

The present invention relates to armaments and more particularly to guided munitions. Even more particularly, the invention relates to a method and system for guiding and controlling a munition by making corrections to the trajectory based on bore sight angle verses time history.

2. Background Information

Mortars are one of the most commonly employed weapons in a ground combat unit. The traditional role of mortars has been to provide close and continuous fire support for maneuvering forces. Military history has repeatedly demonstrated the effectiveness of mortars. Their rapid, high-angle, plunging fires are invaluable against dug-in enemy troops and targets in defilade, which are not vulnerable to attack by direct fires. One of the major disadvantages of mortars is their comparatively low accuracy, and as a result mortars are becoming less effective in today's precision combat environment. Equipping a mortar round with a precision guidance package will increase its accuracy, enabling the mortar to be a precision munition that will be significantly more effective in wartime situations. For maximum utility, the guidance package preferably should be an inexpensive retrofit to current munitions, with a cost in production that allows its use in all situations, either as a guided or unguided weapon.

Unguided munitions are subject to aim error and wind disturbances. These often cause the munition to miss the target completely or require many rounds to complete the fire mission due to the large CEP (Circular Error Probability). Current approaches to guided weapons are expensive and are used on larger long range weapons. The approach described in this disclosure results in significantly lower cost and smaller size. This allows use with small to medium caliber weapons and significantly improves CEP which also results in a significant reduction in the quantity of rounds required to complete the fire mission which in turn results in lower overall cost and improved crew survivability. In addition, another benefit to this approach is the virtual elimination of collateral damage due to errant rounds impacting non-targeted areas.

Mortars are typically unguided or guided by an expensive G&C (guidance and control) system. The cost is high for current guided mortars and unguided mortars have poor accuracy. Also, unguided mortars result in unacceptable collateral damage, excess cost due to large number of rounds required to blanket target area, and expose the mortar crew to counter-battery fire due to large time required to drop the necessary shells to saturate the target.

Unlike powered rockets, mortars and ballistic rounds travel in a ballistic path. It is possible to modify the round by adding large control surfaces so that it can glide. However, this modification requires large wings which could destabilize smaller caliber rounds. In addition, large wings must retract to allow launch from a gun. The large retractable wings are mechanically complex and expensive. A low cost alternative is based on nose mounted canards. In this case, the projectiles maneuverability is limited to less than one G. Thus, the round must take a ballistic path to the target. It is not possible to use a direct homing approach because the target's desired look angle is not at bore sight for a ballistic path and the control surfaces do not have sufficient maneuver capacity to cause the round to fly straight to the target. Platforms such as rockets are able to approach a target in a direct (non-ballistic) path. However this approach is not practical for an unpowered mortar or munition which normally follows only a ballistic trajectory.

The prior art apparatus, systems and methods require considerable, complex, hardware into which a guidance algorithm is integrated. This drives the cost of the individual round excessively and impacts overall round performance, requiring special compensation, for example, to preserve stability. Prior art apparatus suffer from a large CEP and possess no capability against moving targets, this being directly attributable to the highly limited maneuver basket. Prior methods also required costly hardware to support the guidance algorithm integration.

For the basic mortar/small caliber munition there is currently no satisfactory method of guidance and control. For large caliber weapons, a terminal seeker with a direct approach to the target can be incorporated. Use of a direct approach limits the maneuver range. All known existing methods are of little practical use due to cost and accuracy limitations for small and medium caliber munitions.

Therefore there is a need for an accurate and cost effective means for guiding small caliber munitions which follow a ballistic path toward a target, such as mortar shells. There is also a need for an ultra low cost G&C approach for mortar shells which is compatible with a large class of rounds. Also a control algorithm and method is needed to steer a mortar or munition having a limited maneuverability when coupled with appropriate aerodynamic controls. Furthermore, there is a need for a control algorithm that significantly improves mortar/munition terminal accuracy, resulting in reduced cost to prosecute the target, minimizes collateral damage, and increases crew survivability.

BRIEF SUMMARY OF THE INVENTION

According to the present invention a guidance and control method and associated algorithm makes corrections to the munitions trajectory based on the expected bore sight angle vs. time history. The approach works with a limited resolution sensor by looking at pixel crossing times and allows corrections to be done early in the flight. Since the maneuver range is proportional to the square of time to go, the present invention results in a significantly greater maneuver. In the present invention crossing time is compared to a nominal time and is used to make a range correction. The algorithm outputs command information which is sent to a guidance processor which in turn generates the appropriate commands which are sent to control canards mounted on the munition for changing the munition's flight toward a target. Due to physical limitations, the algorithm must be highly efficient to code and implement, and must be capable of a high level of integration with the seeker hardware embodiment which is believed accomplished by the present invention.

The subject invention provides a method and associated control algorithm that allows small, low G control surfaces to steer a projectile to the intended target. The algorithm used in the method of the present invention is based on perturbation of the ballistic path. The maneuver envelope is maximized by starting the correction as early as possible during the flight.

Another aspect of the invention provides a method which initially controls the roll of the munition by use of a plurality of rate gyros which provide input to a Proportional-Integral- Derivative (PID) control loop which supplies steering commands to certain of the guidance control surfaces. Preferably, the selected control surfaces deroll the munition.

A still further feature of the invention is the providing of up/down steering commands to certain of the guidance surfaces to correct for range error depending upon the comparison of the actual flight time of the munition with the expected nominal flight time of the munition.

Another feature of the invention is to provide left/right steering commands to certain of the control surfaces by the cross-track location of a pixel developed by an optical array of photodetectors with respect to a central axis of the munition as the homing seeker and detector oscillates slowly back and forth across the centerline of the detector array when an optical illuminator and detector optics is utilized by the seeker subsystem.

A further feature of the invention is providing the speed of the munition and time of flight to a trajectory estimator processor which supplies information to a control processor which receives bore sight angle information from the seeker subsystem to calculate the required up/down steering commands for controlling the guidance control surfaces.

BRIEF DESCRIPTION OF THE SEVERAL VIEWS OF THE DRAWINGS

The present invention is further described with reference to the accompanying drawings wherein.

Similar numbers refer to similar parts throughout the drawings.

DETAILED DESCRIPTION OF THE INVENTION

Figure 1:
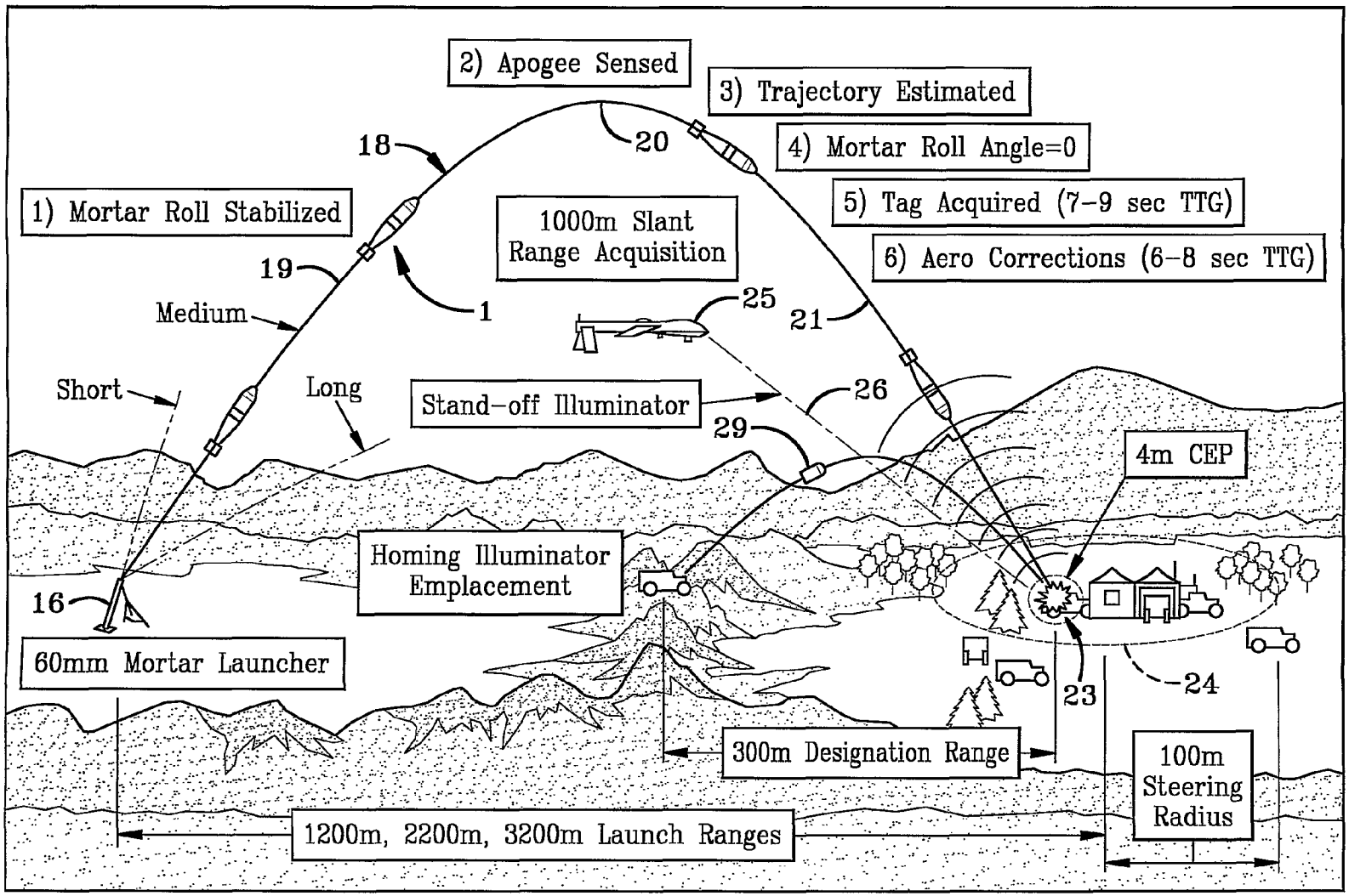
FIG. 1 is a diagrammatic view showing the operation of a preferred embodiment of the ballistic control and associated method of the present invention.
Figures 2, 3:
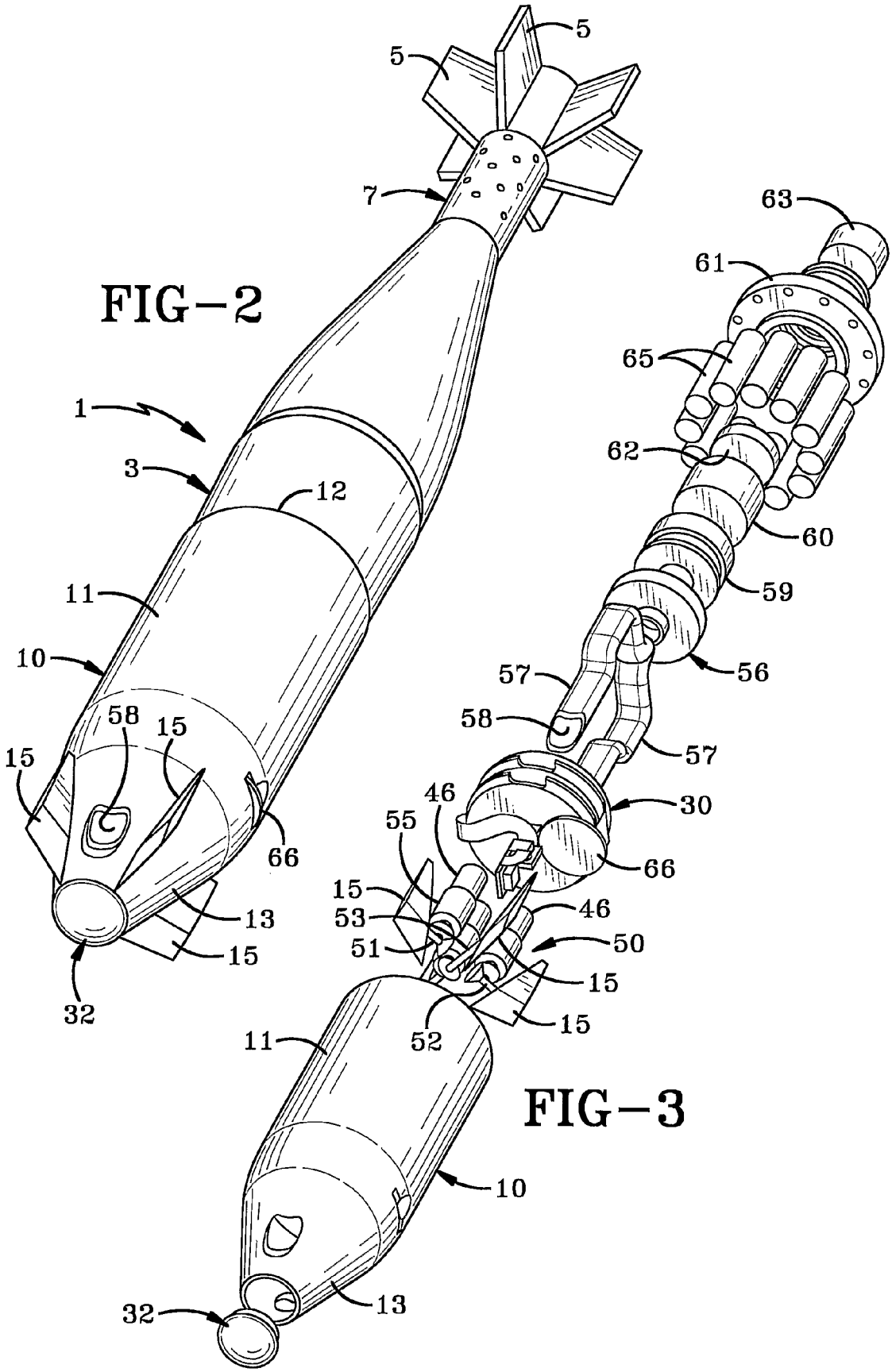
FIG. 2 is a perspective view of one type of munition guided by the ballistic guidance control of the present invention.
FIG. 3 is an exploded perspective view of the fuse mechanism of the munition of FIG. 2 containing the guidance control of the present invention.

A preferred embodiment of the control system and method of the present invention for guiding a munition having a ballistic flight path toward a target is shown diagrammatically in FIG. 1. One type of guided munition is indicated generally at 1, such as a 60 mm mortar. An example of such a mortar shell or round is shown in FIGS. 2 and 3. Mortar 1 includes a main body 3 formed with a hollow interior in which is contained an explosive charge. At the rear of body 3 will be usual aerodynamic stabilizing fin 5 with a propellant charge being located within an adjacent housing 7. A fuse indicated generally at 10, is mounted on the front or fore portion of body 3, preferably by a threaded connection at 12. Fuse 10 includes a housing 11 having a tapered front portion 13 on which is mounted a plurality of guidance canards 15. Fuse 10 replaces a standard nose/fuse construction used with body 3, and enables the ballistic guidance control of the present invention to be incorporated into currently used munitions without requiring major modifications thereto.

Munition 1 can be discharged from a usual mortar launcher 16 (FIG. 1) which propels the munition into a normal ballistic path 18 which is determined by the angle of elevation of the mortar launcher, the weight of the munition, the size of the explosive propelling charge, atmospheric conditions such as wind temperature etc. Munition 1 follows an upward path 19 until it reaches apogee 20 where it starts its downward descent along a projected path 21 with the anticipation that it will hit a target 23 within an acceptable CEP indicated by dashed lines 24.

In one embodiment, target 23 can be illuminated by means of a standoff illuminator 25 which projects a beam 26 onto the target. Beam 26 can be a laser or other type of optical detectable beam. The optical illuminator at target 23 can also be a radiation emitting tag 29 or various other homing devices which emit a detectable signal. The device is placed at the target by various means such as being propelled to the target from a launcher or secretly placed at the target prior to the launch of munition 1, or by various other types of delivery means. These optical illuminators or other types of radiation devices provide a homing signal which is detected by the guidance and control system for carrying out the method of the present invention. The homing device can also be the actual target itself, such as radio frequency (RF) signals emitted by communication signals from the target if an RF guidance mode is utilized instead of the optical system discussed herein. The main feature of the homing device regardless of its particular type of radiation signals produced thereby and method of arriving at the target site, is that it will radiate a recognized signal to direct munition 1 to the target. An optical target illuminator if used as the homing device, preferably will operate at a frequency not visible by the human eye, such as infrared (IR), preventing it from being exposed to an enemy at the target site. Furthermore, the illuminator may operate at a coded frequency which must be validated by munition 1 in order to arm the munition for explosion upon reaching the target.

Figure 4:
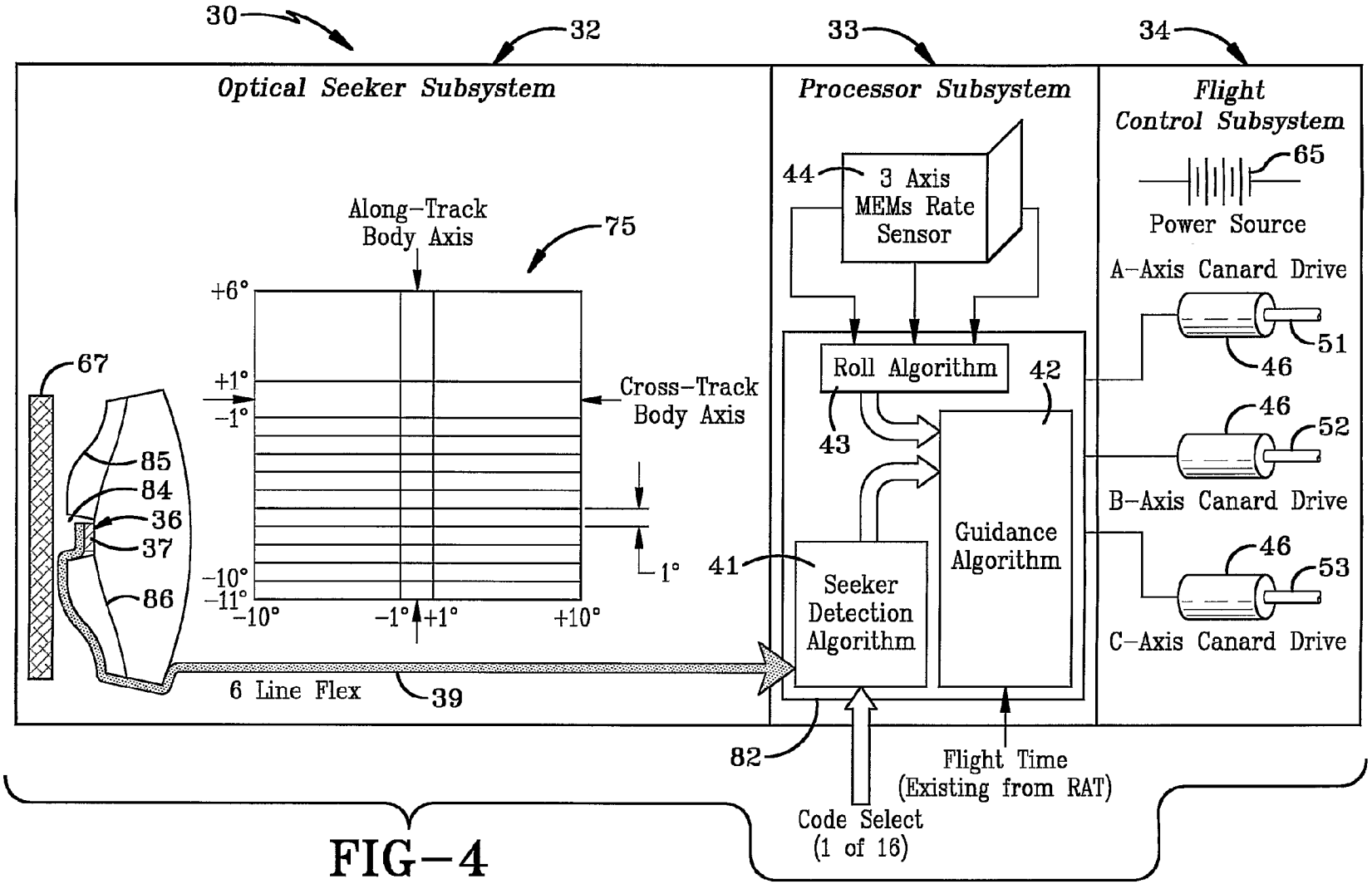
FIG. 4 is a schematic diagram of the ballistic guidance control for carrying out the method of the present invention.
Figure 5:
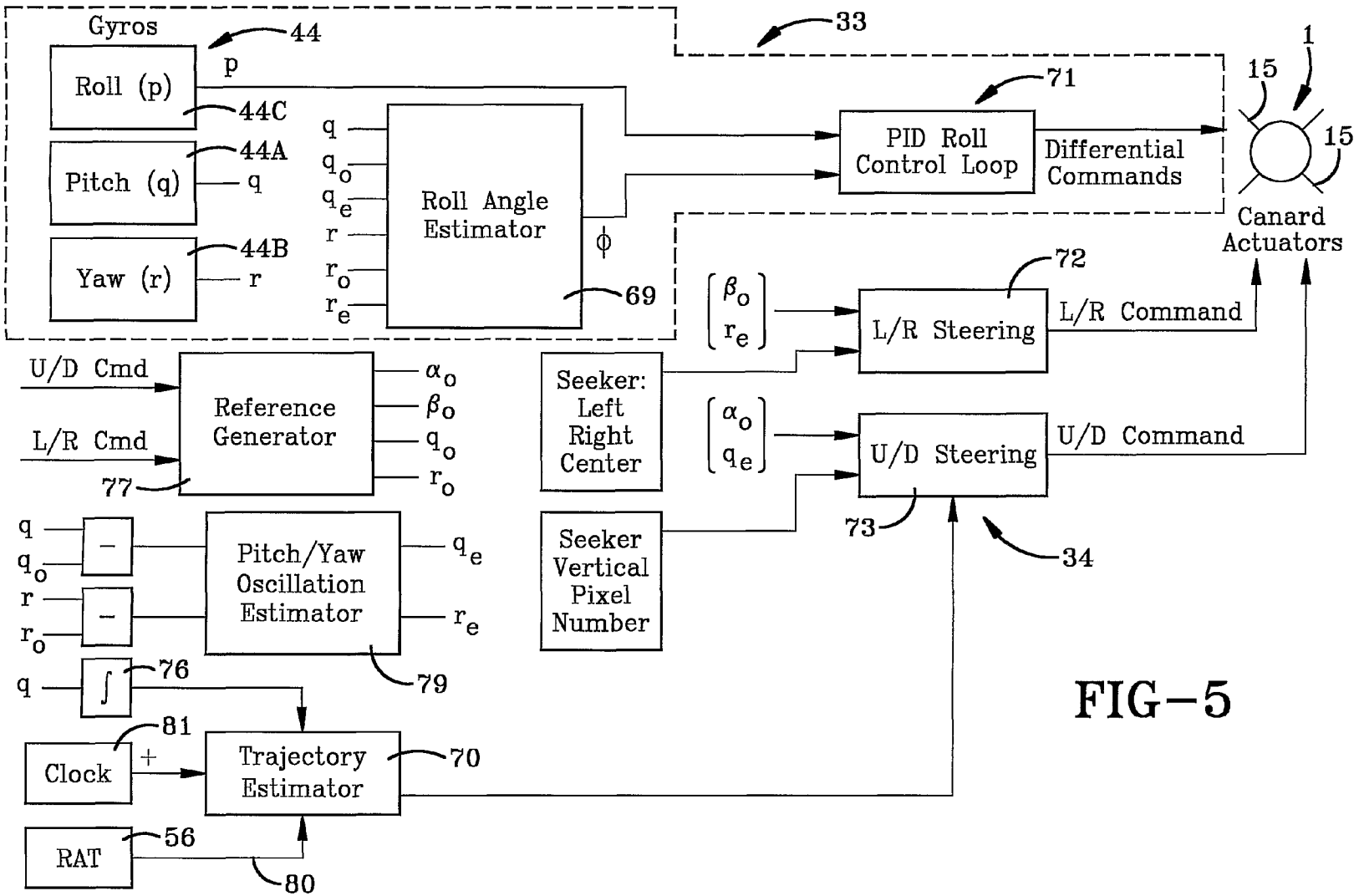
FIG. 5 is a block diagram showing further details of the guidance control system and associated method of the present invention as shown in FIG. 4.

One type of ballistic guidance control system (G&C) for carrying out the method of the present invention is indicated generally at 30, and is shown particularly in schematic block diagram form in FIGS. 4 and 5, when used with an optical illuminator as the homing device. The G&C 30 includes an optical seeker subsystem 32, a processor subsystem 33 and a flight control subsystem 34. One type of optical seeker subsystem 32 which can be used in the present invention is shown and described in detail in a related published patent application U.S. Ser. No. 11/632,671, filed Sep. 25, 2008, Publication No. 2009/0039197 entitled, Optically Guided Munition Control System And Method, the contents of which are incorporated herein by reference.

Optical subsystem 32 includes seeker optics 36 and a detector array 37 formed by a plurality of photodetectors arranged in a section of a sphere. Subsystem 32 communicates with processor subsystem 33 as shown by Arrow 39 (FIG. 4) and provides the input data to a seeker detector algorithm 41 which communicates with a guidance algorithm 42. A roll algorithm 43 receives signals from three rate gyros 44, and provides signals to guidance algorithm 42, which in turn supplies flight control signals to flight control subsystem 34.

Figure 7:
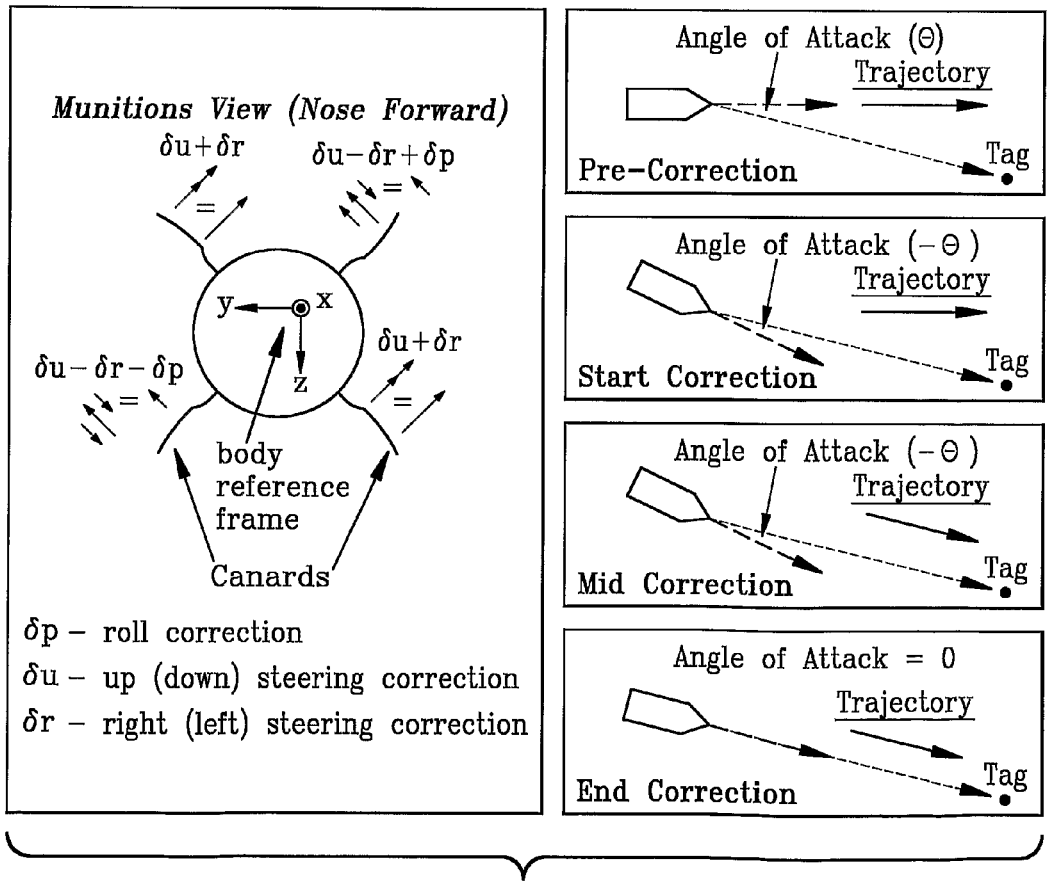
FIG. 7 is a schematic block diagram showing the steering control theory of the present invention.

Steering commands are supplied by processor subsystem 33 to flight control subsystem 34, and in particular to a plurality of preferably drive motors 46 which are connected to a plurality of drive shafts mounted on the nose of the munition (FIGS. 2 and 3) for rotating the flight control surfaces to control the flight of munition 1. Drive motors 46 are part of a guidance control mechanism indicated generally at 50, which consists broadly of the four canards orthogonal 15, two of which are mounted each on independent shafts 51 and 52 for controlling the roll, pitch and yaw of the munition, with the remaining pair of canards 15 being mounted on a single common shaft 53 which is used to control the pitch and yaw of the munition, as shown in FIG. 7. The shafts are controlled by the three drive motors 46, which preferably are high torque two phase stepper motors operatively connected to the canard shafts by gear assemblies 55. Further details of a preferred embodiment of control mechanism 50 is shown and described in a related published patent application U.S. Ser. No. 11/629,921, filed Dec. 18, 2006, Publication No. 2008/0029641 entitled, Three Axis Aerodynamic Control Of Guided Munitions, the contents of which are incorporated herein by reference. Canards 15 can be mid-body mounted wings or other flight control surfaces without departing from the concept of the present invention.

Also located in fuse housing 10 (FIGS. 2 and 3) is a Ram Air Turbine (RAT) 56 including air ducts 57 which supply air through end openings 58 located in tapered portion 13 of housing 11 for controlling an alternator and switch plate assembly 59, a safe/arm rotor assembly 60, and a rotatably mounted barrier plate 62, preferably of a type currently used in existing mortar fuses. An end cap or plate 61 secures the various components in fuse housing 11. A booster pellet 63 is located adjacent end plate 61 within the end of fuse housing 11. An array of batteries 65 is mounted forwardly of end plate 61 for supplying the power for the canard drive motors and for the processor subsystem and optical seeker subsystem. A manually actuated thumb wheel switch 66 may be located in fuse housing 11 for setting a code of the day (COD) into the processor subsystem 33 which can be programmed in the processor to require a match against a code transmitted by the homing device to arm the munition, if desired. Further details of one type of munition which may be guided by the method of the present invention is shown and described in a related patent application U.S. Ser. No. 11/629,062, filed Dec. 8, 2006, now U.S. Pat. No. 7,533,849, entitled, Optically Guided Munition, the contents of which are incorporated herein by reference. Again, the guidance control of the present invention need not be an optically guided munition as discussed, but can use other types of guidance signals radiated by a device at the target or by the target itself.

The guidance and control system 30 and various components discussed above and shown particularly in FIG. 3, are all fitted within the nose 13 which will include the usual fuse components located adjacent booster pellet 63 to cause detonations upon contact, at a certain elevation above the target, with a time delay or other settings well known in the fuse art. Nose 13, which houses all of the components of the smart fuse, is mounted usually by a threaded connection onto outer shell casing body 11 (FIG. 2) replacing the heretofore threadedly attached standard fuse without the guidance and control system discussed above. This results in a slightly longer munition, but one having the same diameter as the previously replaced fuse, enabling it to be launched easily from a usual mortar launcher 16. This provides for a low cost modification to existing munitions. Furthermore, the components of the guidance and control systems are rugged miniature components with the optical seeker subsystem 32 and processor subsystem 33 being formed of printed circuit board components which can be compacted and protected in a rugged manner thereby adding minimal weight to the nose of the munition, yet which provides for the guidance and control of the munition upon approaching a target. Guidance and control system 30 can be implemented on double sided rigid-flex printed circuit boards which are placed in a stacked relationship and have a diameter compatible with the inner diameter of fuse 10 with components mounted normal to the direction of launch to further improve tolerance to launch shock loads as shown in FIG. 3.

In addition to inputs from optical seeker subsystem 32, processor subsystem 33 can receive inputs from the RAT as to the time of flight and apogee determination, a G-switch launcher detector for accurate launch determination, and the input from a thumb wheel switch 66 for authentication code selection as shown in FIG. 4. An integral switch (not shown) with a disposable filter 67 for selection of laser designator versus illuminator can also be provided in optical seeker subsystem 32. Apogee detection can also be supplied to processor subsystem 33 through external data other than the RAT of the fuse, thereby eliminating any specific hardware dependency, if desired.

Further features of the ballistic guidance control system 30 and method of the present invention is shown in FIG. 5, and includes an algorithm which has a roll angle estimator 69, trajectory estimator 70, roll controller 71, left/right steering loop 72, and an up/down steering loop 73. A key feature of the algorithm for carrying out the invention is the roll estimator and the use of an earth based reference frame to resolve the projectile's lateral steering commands. This is required because of the munition's ballistic path. Range error correction is done by the up/down steering loop 73. Errors in range are detected by the target seeker subsystem 32, preferably located in the nose of the munition, which provides pixel crossing times when the target homing device is emitting optical signals, as shown by the body axis graph 75 in FIG. 4. For a nominal trajectory with no range error, the target's bore sight look angle has a nominal look angle history. Thus, the target will cross pixel boundaries at nominal time values in relation to the launch time. Range error is indicated by a deviation from this nominal timing. The U/D (up/down) steering loop 73 makes corrections in range based on this detected timing error. The approach used in the U/D loop is based on making the maximum possible maneuver if a timing error is detected. This correction is maintained until the timing becomes nominal. During the correction, and as a result of the correction, the nominal timing is modified. The control algorithm uses trajectory estimator 70 to continually update the nominal timing data to reflect the fact that the new ballistic trajectory is needed to impact the target. This estimator also includes the angle of attack (AOA) developed as a result of the non-zero canard deflection (FIG. 7).

Errors in cross range are addressed by a conventional direct homing approach because there is no effect in terms of vertical acceleration required. However, a reference generator 77 is used to account for any angle of attack caused by the non-zero canard deflection. Also, maximum deflection is applied until it is determined that munition 1 is on a nominal path to the target. In the case of cross range, this is a straight line (ground track) to the target.

To simplify operation it is desired that the user not be required to provide any trajectory data to the round. To allow this, the algorithm uses gyros 44 and air data from the Ram Air Turbine to estimate the trajectory. A pitch/yaw oscillation estimator 79 is supplied with the pitch rate and yaw rate from the pitch gyro 44A and yaw gyro 44B for supplying roll data to the L/R and U/D steering loops 72 and 73, respectively as shown in FIG. 5 and trajectory estimator 70 is supplied with the pitch rate from a pitch integrator 76.

Guidance and Control Inputs to Detection Processing and Tracking

The approach of the present invention taken for guidance of munition 1 is to combine both "brute force" navigation to the target where the mortar flies a straight line to the target and "ballistic correction" which requires small steering corrections. Key to the navigation approach is target detection and tracking. At the start of control, discrete optical sensor output (seeker output) provided to processor subsystem 33 is used to estimate "down" and adjust the nominal ballistic trajectory based upon detection of the target through processing of the optical seeker quantized data. Range adjustment is based on the bore sight look down angle temporal history, and cross range control is based on the left/right centering error, data for which is an output of the optical seeker subassembly. As the flight progresses, the bore sight look down angle approaches zero. When the lookdown angle is small, then the direct homing approach is used. This approach is selected because it takes advantage of the features of both approaches. The detection processing algorithm 41, through analysis of the seeker output, controls the actual technique selection which is then acted upon through the guidance and control algorithm of the present invention.

The "ballistic correction" approach does not require a high g vertical steering offset. In contrast, the "brute force" approach needs a large command in the early portion of the controlled flight. This favors using a "ballistic correction" at the start of the flight. This approach also eases demands on the detection processing and tracking algorithm.

During the final portion of the controlled flight, the required steering offset is smaller and a "brute force" approach can be used. The advantage of the "brute force" approach is that it is insensitive to trajectory estimation error or down estimation, both factors ease the burden on the detection processing and tracking algorithms providing an intrinsic robustness.

The approach to aerodynamic control is to stabilize the roll vector of the mortar round, preferably deroll the munition body. As manufactured, a typical mortar round or similar type of munition is free to roll. Since the existence of body roll is indeterminate initially upon launch tube exit, the roll vector itself cannot be relied on to provide any method of control. Any optical sensor would either have to be derolled or have an excessively large field of regard (FOR) to be able to acquire and track the target at the extreme acquisition ranges in any arbitrary attitude. Additionally, the processing to determine the "down" vector is greatly simplified with a stabilized roll component.

The approach of the present invention for guiding the munition toward a target is shown diagrammatically in FIG. 7, and derives the absolute maximum normal force in the direction of the target as quickly as practical by deliberately controlling, then rolling the mortar airframe first into an X orientation relative to the target, then deflecting all four canards to develop the normal acceleration in the direction of the target. This method brings to bear all four canard surfaces in terms of maneuver force. It also positions the optical seeker field of view (FOV) in an optimal location to facilitate target tracking and output to the detection processor and integration of the guidance algorithm.

An initial set of key performance features for the optical seeker subsystem are shown in FIGS. 4-8. These are ultimately tied back to the detection processing and tracking algorithm as input data. Specifically, the field of view (FOV) format is key to proper target recognition, tracking, and the steering commands generated as a result of the work performed in the detection and tracking algorithm.

In a preferred embodiment, the seeker optics 36 has a 20-mm entrance-aperture diameter, with a field of regard (FOR) of ±10° cross-track and +6° to −11° along-track as shown by body axis graph 75 in FIG. 4. The physical size of the detector array 37 is approximately 2×2 mm. From these requirements it has been determined that the system's f-number must be on the order of 0.24. It is not theoretically possible to achieve this low f-number using a purely refractive system, due to the high curvatures required.

Since the detector array is centered on the optical axis, the entire optical system will be canted down 6° relative to a central axis of the munition body, in order to provide the required FOR of −11° to +6° in the along-track direction. A central hole 84 in a lens element 85 provides the necessary clearance for detector array 37 to be bonded to a central flat area on a second lens element 86. Array 37 is a non-imaging optic detector array mounted as a central obscuration on lens element 86.

Detection processing and tracking is intimately tied to optical seeker output performance. The tracking is established when a target, in particular an illuminating tag, appears as a pixel in a portion of the optical array. Position is determined and steering commands generated in order to null the error in both the cross track and along track axis. Canting of the optical array reduces the cost of the system by eliminating the need for a complete spherical array of radiation detectors.

Control Processor System

The control processor subsystem 33 performs three primary functions: detection processing of the seeker output to validate the correct one of a number of possible authentication codes from the illuminator if used in the munition, and provide validated seeker outputs for navigation; secondly, establish roll control of the mortar round based on included inertial sensors (gyros 44), preferably negating any roll of the munition (PID control loop 71); and thirdly, provide steering commands to the flight control subsystem canards 15 based on roll control and seeker outputs. In addition to inputs from the optical seeker subsystem 32, the control processor subsystem, and in particular trajectory estimator 70 thereof (FIG. 5), receives inputs from the Ram Air Turbine 56 of the fuse as shown by data input line 80, which is the speed of the munition. The time of flight also is supplied to trajectory estimator 70 by clock 81. Typically, other fuse components can be incorporated for time of flight and apogee determination, a g-switch launch detector for accurate launch determination, and the body mounted thumbwheel switch 66 for authentication code selection if desired. Apogee detect can also be supplied through external data other than the RAT 56 of the fuse thereby eliminating any specific hardware dependencies.

Seeker Detection Processing—A number of different approaches can be utilized for efficient application of signal processing to further optimize the receiver performance. To minimize cost, signal processing is combined with the requirement for temporal discrimination for multiple homing illuminators. The approach selected is a two pulse coincidence gate where the coincidence time was selective for 1 of 16 different windows. The physical selection is with a rotary switch located on the external periphery of the fuse shell.

Figure 8:
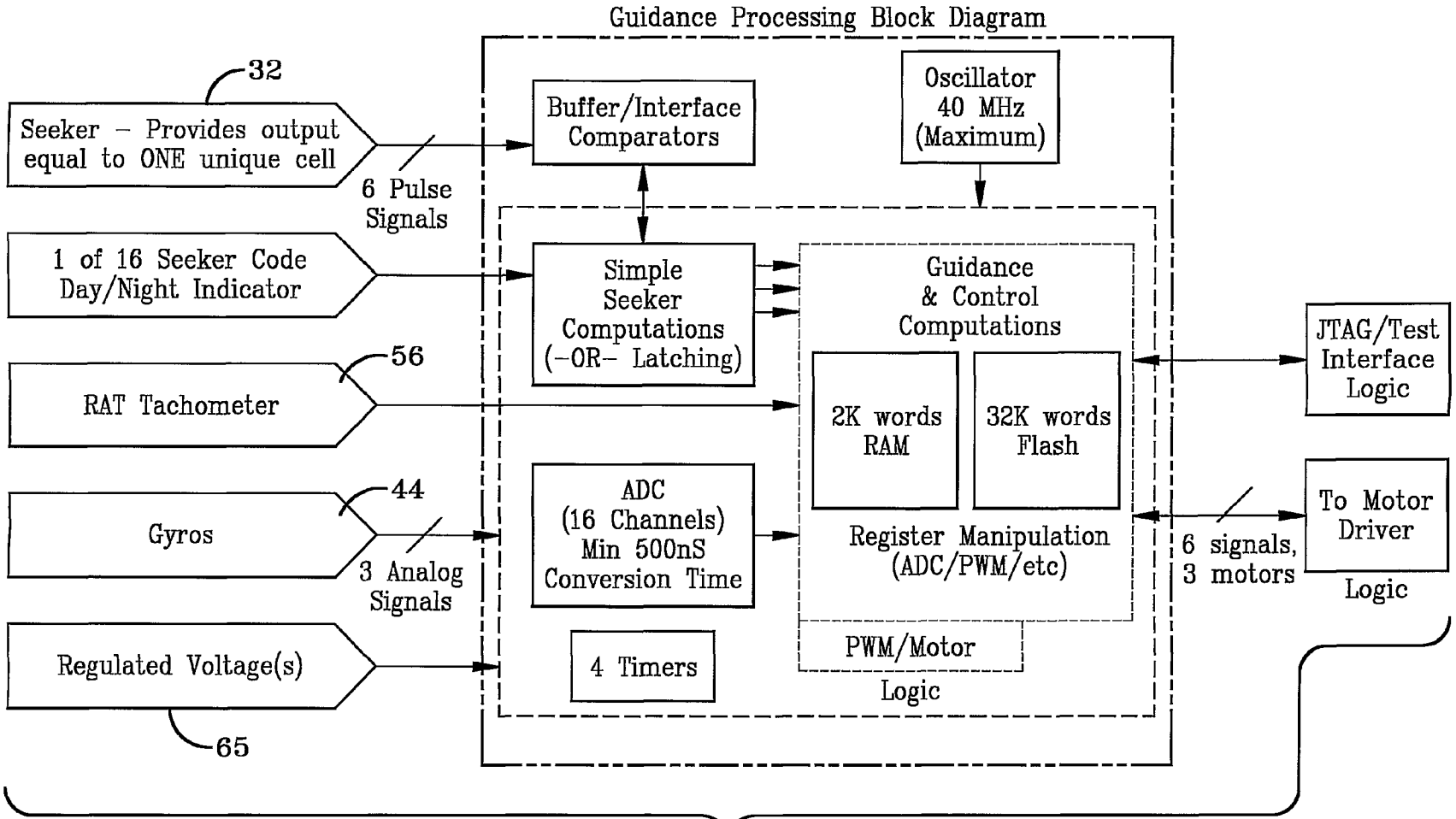
FIG. 8 is a schematic diagram of the guidance and control functional processing block diagram for a preferred embodiment of the present invention.

Simulations of signal acquisition with a signal to noise ratio (SNR) consistent with a 0.1/sec false alarm rate and adequate detection probability (>6 dB) have demonstrated that a signal can be reliably acquired within 64 msec (FIG. 8). This is more than adequate to meet the guidance requirements for all shots. When operating with legacy laser target designators, coincidence gating is bypassed since no unique codes are required for this operation. If desired, processing could be modified to include current MIL-STD EOCCM codes.

Figure 6:
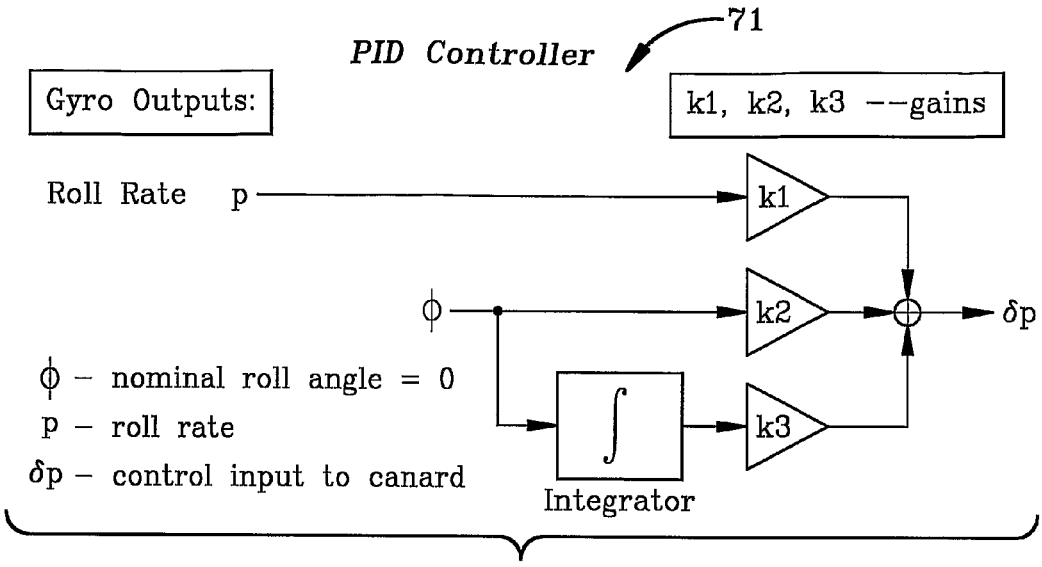
FIG. 6 is a schematic block diagram of the Proportional-Integral-Derivative (PID) controller used in controlling the roll of the munition in the method of the present invention.

Roll Control—Zero roll is maintained by using the Proportional-Integral-Derivative (PID) control loop indicated generally at 71, (FIG. 6). The "proportional" and "integral" inputs come from the pitch and yaw rate gyros 44A and 44B, respectively. The "derivative" input comes from the roll rate gyro 44C. These three inputs are combined to estimate the instantaneous roll rate component and steer the canards appropriately to offset this roll effect as shown in FIG. 7, that is, deroll munition 1.

Steering Control—Steering control has two separate components: YAW (left/right) control, in which the canards, acting in pairs, provide horizontal displacement, and Elevation (up/down) in which the canards, again operating in pairs, provide an increment or decrement to the projectile range. Two of the diagonally opposed canards also provide the roll control discussed above. FIG. 7 demonstrates this effect.

Input to the flight or steering control subsystem comes from the seeker detection processor 82, which provides information regarding the mostly likely pixel array element at rates between 10 Hz (laser designators) and 1 KHz (seeker illuminator). The steering control processor estimates the bore sight offset location at >10 Hz rate. This allows the steering control processor to provide a finer estimate than the seeker processor provides.

Left/Right Steering Correction—The horizontal steering correction term is determined from the left/right centering error determined from the sensor array 37 when an optical seeker subsystem is used for carrying out the method of the present invention. This error is used to determine the necessary correction to drive the canards to correct any lateral aiming error. The flight control subsystem also monitors the bore sight angle and accounts for any angle of attack (AOA) developed because of the steering command and repositions the canards accordingly. An outline of this process is shown in FIG. 7. In the actual flight control subsystem, the canard positions will be continually updating, therefore the angle of attack will be constantly adjusted. Thus, the instantaneous illumination of the homing illuminator will slowly oscillate back and forth across the centerline of the detector array.

Up/Down Steering Correction—Vertical steering correction is done in a similar manner to the horizontal steering correction. However, unlike the left/right correction where the desired horizontal angle of attack is known and equals zero (at the detector array centerline of body axis graph 75), the up/down correction requires a vertical angle of attack which is dependent on the mortar trajectory and time to impact. By using the RAT developed time-to-apogee, an estimate of the mortar trajectory and remaining time of flight can be determined. A table in the processor subsystem can store the allowable mortar trajectories and will fit the best match to the true trajectory. Using this desired trajectory the desired vertical angle of attack can be determined at each 10 Hz update point. The true vertical angle of attack can then be compared to this desired angle of attack and the necessary correction can be made. The up/down steering correction is combined appropriately with the roll correction to deflect the canards as appropriate.

As shown in FIG. 7, a two axis configuration with 3 degrees of freedom (DOF) is preferred which will provide (1) roll stabilization by a differential canard deflection, (2) left/right steering, and (3) up/down steering. In this 3-DOF controller approach, a vertical reference is estimated and the projectile is rolled to a fixed roll angle. With a fixed roll angle, it is then possible to command up/down and/or left/right turns to adjust the trajectory.

The trajectory correction approach of the present invention involves estimation of the trajectory and a determination of the impact point relative to the target. If the mortar is on course, the target will be centered with respect to the left/right center line (FIG. 4). It will also be aimed at the proper elevation angle vs. time. Thus, the downward look angle will follow a specific time history. For a cross track error the location of the target with respect to the left/right of the bore sight center line is the "horizontal" error signal. This error is used to deflect the canards to correct the cross track error. In this case a trajectory estimate is not needed, and only an estimate of down is required to roll the mortar to zero degree roll angle.

To correct along-track errors, the "vertical" error signal is computed from the difference between the nominal bore sight look down angle and the bore sight look down angle measured by the seeker. To implement this approach, the trajectory is estimated by using time to apogee and launch speed. This trajectory estimate is then used to provide the nominal look down angle to the impact point. This nominal angle is time dependent and decreases a few degrees per second. This nominal value is compared to the seeker value detected by the seeker subsystem. If the nominal value exceeds the seeker value then the current trajectory will pass over the target. In this case a downward correction is applied which actuates the appropriate canards as shown in FIG. 7. If the nominal value is less than the measured value, an upward correction is applied to the appropriate canards.

In the absence of gravity, the nominal bore sight look down angle would be zero. In this case the mortar has a "direct fly in" approach. The effect of gravity diminishes as the mortar closes on the target for short range shots using high quadrant elevation (>45 degrees) because the approach angle is closer to vertical. Thus the ballistic correction approach morphs into a direct fly in approach.

When a maneuver command is applied, the mortar develops an angle of attack (AOA). This AOA shifts the look angle to the target. As an example, for a 0.2 g maneuver a 6-DOF model shows that the AOA will be about 1.9 degrees. Thus, if the projectile is initially aimed 1 degree to the right of the target in the horizontal direction and a 0.2 g left maneuver is commanded, the target look angle will be 0.9 degrees to the right. As the mortar velocity vector turns left towards the target, the look angle will move further to the right. This does not indicate an over shoot. In fact the turn must be continued until the look angle is 1.9 degrees to the right. At this point the canards are zeroed and the AOA trims back to zero. With zero AOA and the velocity vector pointing to the target, the look angle will be zero. It is important to account for this AOA effect when steering because the expected AOA will be of comparable magnitude to the aim angle error.

The detection and target tracking functionality are integrated within the overall guidance and control system shown in FIGS. 4, 5 and 8. It is anticipated that the functionality of the guidance and control system 30 can be implemented on double sided rigid-flex printed circuit boards similar to those already implemented for existing M734A1 fuses. The individual circuit boards are compatible with the inner diameter of fuse 10 with components mounted normal to the direction of launch acceleration to further improve tolerance to launch shock loads as shown in FIG. 3. This approach has been demonstrated successfully in environments of over 25 kg's in large caliber munitions such as the 105 and 155 mm guided howitzer shells.

Gyros 44, preferably use MEMS technology and sense body rate, (yaw, pitch, and roll). These gyros are incorporated into the G&C system 30 and preferably are mounted in an orthogonal array in the mid-body section of the fuse. These gyros as commercially available, such as from Analog Devices, Inc., and have been demonstrated to over 2 kg's acceleration loads and are able to sustain launch at the 4.5 kg's level without modification. Other components can be obtained from demonstrated high g shock technologies in order to meet the required setback levels. Thus no new component technology is required to develop, host, integrate, test, and field the detection processing and target tracking algorithm of the present invention, thereby reducing the cost of fuse 10.

Those skilled in the art will appreciate that the method, apparatus and system of the present invention provides highly efficient means compatible with existing processor technology. Furthermore, the method, system and apparatus of the present invention also supports a variety of seeker output designs and interfaces and are compatible with multiple coded input signals and need not be the optical system shown in the drawings and discussed above.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A method for guiding and controlling a munition having an in-flight trajectory and a bore sight angle by making corrections to the ballistic trajectory based on an observed bore sight angle including the step of derolling the munition before making corrections to the trajectory by providing a Proportional-Integral-Derivative control loop; providing a pitch rate gyro for obtaining the proportional input to the control loop, a yaw rate gyro for obtaining the integral input, and a roll rate gyro for obtaining the derivative input; and supplying, pitch, yaw and roll steering commands to flight control surfaces mounted on the munition from signals received from the pitch, yaw and roll rate gyros for guiding and controlling the munition.

2. A method for guiding and controlling a munition having an in-flight trajectory toward a target comprising the steps of:

determining nominal time values of the ballistic trajectory in relation to launch time values;

determining deviation from the nominal time values of the munition during flight by an algorithm by analyzing signals received from the target;

making up/down steering corrections to the munition based upon the deviation from the nominal time values to correct for range error;

derolling the munition;

determining a nominal look down angle of the munition to the target;

determining a true look down angle of the munition by the algorithm analyzing signals received from the target; and applying upward corrections to the munition if the nominal angle is less than the true angle.

3. A system for guidance and control of a projectile following an in-flight path toward a target, said target having a homing signal being radiated therefrom, said system comprising:

a plurality of guidance surfaces mounted on the projectile;

a projectile guidance and control algorithm located in the projectile for supplying signals to the guidance surfaces for directing the projectile toward the target, said algorithm including:

a roll angle estimator for determining the roll angle of the projectile;

a roll controller for receiving signals from the roll angle estimator and for developing steering commands supplied to certain of the flight control surfaces for controlling the roll of the projectile;

a trajectory estimator for estimating the trajectory of the projectile;

a left/right (L/R) steering loop and an up/down (U/D) steering loop for supplying guidance signals to the flight control surfaces; and a seeker subsystem for receiving homing signals from the target and supplying error correction signals to the L/R and U/D steering loops for changing the trajectory of the projectile.

4. The system defined in claim 3 wherein the projectile includes a Ram Air Turbine (RAT) which inputs the launch speed and time of flight of the projectile to the trajectory estimator.

5. The system defined in claim 3 wherein the roll controller is a Proportional-Integral-Derivative (PID) loop; in which the projectile contains a roll gyro, a pitch gyro and a yaw gyro, said roll gyro supplying signals to the PID loop and said pitch and yaw gyros supplying signals to the roll angle estimator.

6. The system defined in claim 5 wherein the pitch and yaw gyros provide signals to a pitch/yaw oscillation estimator which supplies signals to the L/R and U/P steering loops.

7. A method for guiding and controlling a munition having an in-flight trajectory comprising the steps of determining the launch speed of the munition and the estimated flight time of the munition to apogee; estimating the trajectory of the munition based upon the estimated flight time to apogee and determined launch speed; determining the desired angle of attack (AOA) of the munition from the estimated trajectory; receiving homing signals from a target; determining the true angle of attack from the received homing signals; and supplying flight correction signals to flight control surfaces on the munition based upon deviations of the true angle of attack from the desired angle of attack.

8. The method defined in claim 7 including the step of derolling the munition before making corrections to the trajectory.

9. A method for guiding and controlling a munition having an in-flight trajectory by making corrections to the trajectory comprising the steps of receiving homing signals from the target; determining a nominal look down angle of the munition to the target; comparing the nominal look down angle to a seeker value derived from the homing signals; and applying an up/down steering command to a plurality of flight control surfaces mounted on the munition to compensate for a difference between the nominal look down angle and the seeker value.

10. A method for guiding and controlling a munition having an in-flight trajectory comprising the steps of providing an optical seeker on the munition; canting the optical seeker toward a target with respect to a central axis of the munition; looking at pixel crossing times with the optical seeker when a target homing device is emitting optical signals; and comparing the pixel crossing times to nominal crossing times of an allowable trajectory stored in a processor in the munition; and making corrections to the trajectory by supplying corrections to flight controls on the munition based upon deviations of the looked at pixel crossing times from the nominal crossing times.

11. A method for guiding and controlling a munition having an in-flight trajectory by making corrections to the trajectory comprising the steps of derolling the munition; receiving homing signals from a target; developing the bore sight angle of the munition from the homing signals; developing the time history of the munition by comparing an estimated trajectory of the munition against a nominal trajectory of the munition stored in a processor in the munition; and supplying steering commands to flight control surfaces of the munition for guiding and controlling the munition based upon the developed time history of the munition to control the trajectory of the munition.

12. A method for guiding and controlling a munition having an in-flight trajectory and a bore sight angle by making corrections to the trajectory based on observed bore sight angle including the steps of:

receiving homing signals from a target as the munition follows the in-flight trajectory toward the target;

generating steering commands based upon the received signals;

providing said steering commands to a plurality of flight control surfaces mounted on the munition which includes the further steps of:

estimating the munition's trajectory;

matching the estimated trajectory against nominal trajectories stored in a processor in the munition to determine the true angle of attack (AOA); and providing up/down steering corrections to certain control surfaces based upon a comparison of the true vertical AOA against a desired AOA for range error correction.

13. The method defined in claim 12 including the steps of determining the remaining time of flight of the munition to the target; and combining said time with the estimated trajectory of the munition to determine the true vertical AOA.

14. A method for guiding and controlling a munition having an in-flight trajectory and a bore sight angle by making corrections to the trajectory based on observed bore sight angle including the steps of:

receiving homing signals from a target as the munition follows the in-flight trajectory toward the target;

providing the homing signal with a code;

validating the homing signal code with respect to a code stored in a processor in the munition prior to arming the munition;

generating steering commands based upon the received signals; and providing said steering commands to a plurality of flight control surfaces mounted on the munition.

15. The method defined in claim 14 wherein the step of providing steering commands includes the step of determining left/right centering error from the received signals and correcting any centering error by moving certain flight control surfaces.

16. A method for guiding and controlling a munition having an in-flight trajectory and a bore sight angle by making corrections to the trajectory based on observed bore sight angle including the steps of:

determining the launch speed of the munition and the estimated flight time of the munition to the apogee of the trajectory;

estimating the trajectory of the munition based upon the flight time to apogee and launch speed;

determining the angle of attack (AOA) of the munition from the estimated trajectory;

receiving homing signals from a target as the munition follows the in-flight trajectory toward the target;

generating steering commands based upon the received signals; and providing said steering commands to a plurality of flight control surfaces mounted on the munition.

17. A method for guiding and controlling a munition having an in-flight trajectory and a bore sight angle by making corrections to the trajectory based on observed bore sight angle including the steps of:

receiving homing signals from a target as the munition follows the in-flight trajectory toward the target;

generating steering commands based upon the received signals;

providing said steering commands to a plurality of flight control surfaces mounted on the munition; and sensing gravity induced overturning moment of the munition to provide a down reference to the munition for subsequently controlling the roll of the munition.

* * * * *